US010697329B2

(12) United States Patent
Moll et al.

(10) Patent No.: US 10,697,329 B2
(45) Date of Patent: Jun. 30, 2020

(54) TURBINE DIAPHRAGM DRAIN

(71) Applicant: DRESSER-RAND COMPANY, Olean, NY (US)

(72) Inventors: Randall W. Moll, Scio, NY (US); Daniel Flurschutz, Wellsville, NY (US); George M. Lucas, Hammondsport, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 40 days.

(21) Appl. No.: 16/306,272

(22) PCT Filed: Jul. 18, 2017

(86) PCT No.: PCT/US2017/042488
§ 371 (c)(1),
(2) Date: Nov. 30, 2018

(87) PCT Pub. No.: WO2018/034765
PCT Pub. Date: Feb. 22, 2018

(65) Prior Publication Data

US 2019/0218941 A1 Jul. 18, 2019

Related U.S. Application Data

(60) Provisional application No. 62/376,500, filed on Aug. 18, 2016.

(51) Int. Cl.
*F01D 25/32* (2006.01)

(52) U.S. Cl.
CPC ..... *F01D 25/32* (2013.01); *F05D 2220/31* (2013.01); *F05D 2260/602* (2013.01)

(58) Field of Classification Search
CPC . F01D 25/32; F05D 2220/31; F05D 2260/602
(Continued)

(56) References Cited

U.S. PATENT DOCUMENTS 1,696,002 A 12/1928 Hanzlik

FOREIGN PATENT DOCUMENTS

EP 2889456 A1 7/2015
GB 461600 A 2/1937
(Continued)

OTHER PUBLICATIONS

PCT International Search Report and Written Opinion of International Searching Authority dated Nov. 16, 2017 corresponding to PCT International Application No. PCT/US2017/042488 filed Jul. 18, 2017.

*Primary Examiner* — Richard A Edgar

(57) ABSTRACT

A drainage system for a stage of a turbine. The drainage system may include at least one annular recess defined in the inner surface of the casing of the turbine and configured to accumulate liquid therein. An axial slot and a radial slot may be formed in a diaphragm of the turbine, the axial slot extending between the upstream and downstream faces of the diaphragm. The drainage system may further include a tubular member including an axially extending tubular portion disposed in the axial slot and a radially extending tubular portion disposed in the radial slot. The radially extending tubular portion may be sized and configured to fluidly couple the at least one annular recess and the axially extending tubular portion, such that liquid in the at least one annular recess may be drained therefrom and discharged from the stage of the turbine via the axially extending tubular portion.

20 Claims, 3 Drawing Sheets

(58) Field of Classification Search
USPC ..... 415/169.2
See application file for complete search history.

(56) References Cited

FOREIGN PATENT DOCUMENTS

| | | | | | |
|---|---|---|---|---|---|
| GB | 1135176 | A | | 12/1968 | |
| JP | 03185201 | A | * | 8/1991 | ..... F01D 25/32 |
| JP | H0861006 | A | | 3/1996 | |

* cited by examiner

TURBINE DIAPHRAGM DRAIN

This application claims the benefit of U.S. Provisional Patent Application having Ser. No. 62/376,500, which was filed Aug. 18, 2016. The aforementioned patent application is hereby incorporated by reference in its entirety into the present application to the extent consistent with the present application.

Steam turbines may be utilized to extract and convert energy from steam into mechanical work that may be used to drive a generator or process machinery. To that end, a steam turbine may generally include a casing having one or more stages disposed therein and forming in part a flow path for the steam flowing therethrough. In the context of a steam turbine, a "stage" may include a stationary component, commonly referred to as a diaphragm, and a rotating component including a row of rotating blades disposed downstream from the diaphragm. Typically, the diaphragm may include a row of stationary vanes, commonly referred to as nozzles, coupled to and extending between an inner stator ring and an outer stator ring. The nozzles may be arranged to increase the velocity of the steam flowing therethrough and to further direct the steam to the row of rotating blades disposed downstream from the nozzles.

Each outer stator ring of the diaphragm may be disposed in a respective annular groove formed in an inner surface of the casing. As the steam is expanded in a stage, a pressure differential across the diaphragm forces the downstream face of the diaphragm against a downstream radially-extending surface of the inner surface of the casing defining the annular groove, thus forming a seal and the location of such referred to herein as the seal face. As steam flows through the flow path of the steam turbine and is expanded, moisture, including condensate, may accumulate at the bottom of the casing in each stage, which if left unattended may lead to erosion, reduced efficiency, and in some cases, failure of the steam turbine. In particular, the accumulation of condensate in the annular groove may enable contact of the condensate with the seal face, thus leading to erosion of the seal face.

Accordingly, those of skill in the art have proposed various solutions for the removal of the accumulated condensate at the bottom of the casing. For example, one such solution has been the inclusion of a drain at each stage of the steam turbine, where each drain extends radially and externally from the steam turbine and is fluidly coupled to a main condenser or other piping having a lower pressure therein. However, the inclusion of such a drain at each stage may be expensive, especially if retrofitting is necessary, and in addition, the requisite piping occupies additional space, which may be limited in certain environments.

Another proposed solution has been the drilling of one or more axial orifices through the diaphragm at or near the bottom dead center thereof in order for the condensate to drain to the next stage. Progressively larger axial orifices may be drilled in successive diaphragms as the amount of condensate accumulates, until the condensate passes the last stage diaphragm and drains to a condenser. As positioned, these axial orifices are located radially inward of the seal face, such that condensate accumulates in the stage until reaching the axial orifice(s) to drain through to successive stages. As such, the seal face is submerged before the accumulated condensate may drain to the next stage, and thus condensate may be forced via the pressure differential through any imperfections or imperfectly sealed areas on the seal face. Such contact may lead to erosion of the seal face, which may become progressively worse until repair or even replacement of the casing is required to restore turbine performance.

What is needed, therefore, is an improved system and method for removing accumulated liquid at the bottom of the casing of a turbine, such that erosion or other damage to turbine components, such as the seal face, is substantially reduced or eliminated.

Embodiments of the disclosure may provide a drainage system for a stage of a turbine. The drainage system may include a casing defining a cavity. The casing may include a center axis and an inner surface defining at least one annular recess sized and configured to accumulate liquid therein. The drainage system may also include a diaphragm disposed within the cavity. The diaphragm may include a first annular face defining a first face opening, and a second annular face axially opposing the first annular face and defining a second face opening. The diaphragm may define a first slot extending axially between the first face opening and the second face opening. The diaphragm may further include an outer surface extending between the first annular face and the second annular face and forming an annular rib disposed in the at least one annular recess. The annular rib may define a second slot extending radially outward from the first slot. The drainage system may further include a tubular member including an axially extending tubular portion disposed in the first slot and a radially extending tubular portion disposed in the second slot. The radially extending tubular portion may be sized and configured to fluidly couple the at least one annular recess and the axially extending tubular portion.

Embodiments of the disclosure may further provide an expander. The expander may include a casing defining a cavity. The casing may include a center axis and an inner surface defining a first annular recess and a second annular recess. The second annular recess may extend radially outward from the first annular recess and may be sized and configured to accumulate liquid therein. The expander may also include a rotary shaft at least partially disposed within the cavity and configured to rotate about the center axis. The expander may further include at least one stage having a rotor assembly disposed within the cavity and including a rotor disc coupled to the rotary shaft and a plurality of rotor blades coupled to and extending radially from the rotor disc. The at least one stage may also include a stator assembly including a plurality of stator vanes disposed circumferentially about the center axis and extending radially inward from an outer stator ring. The outer stator ring may include an upstream face and a downstream face. The outer stator ring may define a first slot extending axially between the upstream face and the downstream face. The outer stator ring may further include an outer surface forming an annular rib disposed in the first annular recess. The annular rib may define a second slot extending radially inward from the outer surface and terminating in the first slot. The expander may also include a drain defined in the inner surface of the casing and disposed downstream from the at least one stage and configured to fluidly couple the second annular recess with a condenser via a fluid pathway formed in part from the first slot and the second slot.

Embodiments of the disclosure may further provide a method for removing liquid from a stage of a turbine. The method may include disposing a tubular member having an axially extending tubular portion and a radially extending tubular portion in a respective axial slot and radial slot defined in a diaphragm of the stage at or proximal a bottom dead center of the diaphragm. The method may also include expanding a process fluid in the turbine creating a pressure differential between a portion of the turbine upstream of the stage and a portion of the turbine downstream of the stage. The method may further include collecting liquid in an annular recess extending radially outward from a diaphragm recess defined in an inner surface of a casing of the turbine, a portion of the diaphragm disposed within the diaphragm recess. The method may also include drawing the liquid from the annular recess and into the axial slot via the radial slot before the liquid exceeds the volume of the annular recess, and discharging the liquid from the tubular member to a drain disposed downstream from the stage.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
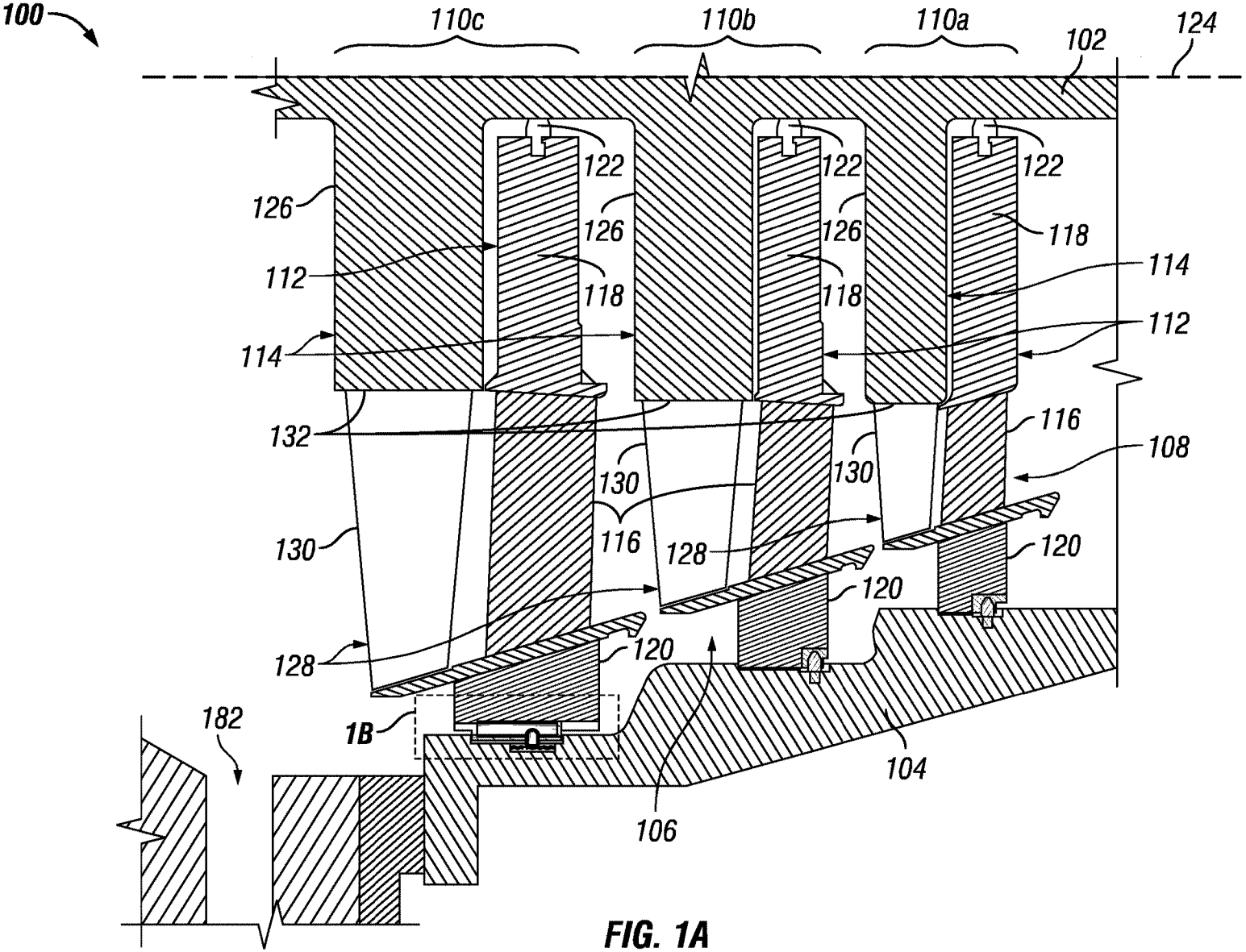
FIG. 1A illustrates a cross-section view of a portion of a steam turbine, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

As used herein, the term "substantially reduce" means to reduce to a measurable extent.

Example embodiments disclosed herein provide systems and methods for removing liquids from one or more stages of a turbine. The systems and methods disclosed herein may substantially reduce or prevent condensate from accumulating in a bottom portion of the casing of a steam turbine and contacting the seal face of the diaphragm and casing. Substantially reducing or preventing condensate from contacting the seal face of the diaphragm and casing may substantially reduce or eliminate erosion of the seal face and other components downstream thereof in the steam turbine.

FIG. 1A illustrates a cross-section view of a portion of a turbine, illustrated as a steam turbine 100, according to one or more embodiments disclosed. Although illustrated as a steam turbine, it will be appreciated that the turbine may be, for example, an expander or a gaseous turbine. The steam turbine 100 may be configured to extract and convert energy from a process fluid including steam into mechanical work that may be used to drive a generator or process machinery. In at least one embodiment, a power generator (not shown) may be coupled with the steam turbine 100 via a rotary shaft 102 and configured to convert the rotational energy into electrical energy. The electrical energy may be transferred from the power generator to an electrical grid (not shown) via a power outlet (not shown) coupled therewith. In another embodiment, a compressor, pump, or other process component may be coupled with the steam turbine 100 via the rotary shaft 102 and driven by the steam turbine 100.

The steam turbine 100 may have a casing 104 or housing defining a cavity 106 and in part a flow path 108 extending from a turbine inlet (not shown) to a turbine outlet (not shown). The steam turbine 100 may be fluidly coupled with a process fluid source (not shown), such as a steam generation plant or process component (e.g., boiler), capable of supplying a process fluid stream, e.g., steam, to the steam turbine 100. In at least one embodiment, the process fluid source may be or include a geothermal source and the process fluid stream may be or include a geothermal fluid stream. The geothermal fluid stream may include a multiphase fluid having a plurality of phases of varying densities. For example, the geothermal fluid stream may include a gaseous phase (i.e., steam) and a liquid phase (i.e., water). In embodiments in which an expander or gaseous turbine is implemented, the process fluid may include, but is not limited to, hydrogen, carbon dioxide, methane, ethylene, or mixtures of hydrocarbons.

As illustrated in FIG. 1A, the steam turbine 100 is a multi-stage steam turbine (three stages shown 110*a*, 110*b*, 110*c*); however, in other embodiments, the steam turbine 100 may be a single-stage steam turbine. The configuration of the steam turbine 100, e.g., the number of stages, may be determined based on, amongst other factors, operational requirements. Each stage 110*a-c* may include a stator assembly, or diaphragm 112, and a rotor assembly 114 axially spaced and downstream from the diaphragm 112. The diaphragm 112 may include a row of stator vanes 116, or nozzles, coupled to and radially extending between an inner stator ring 118 and an outer stator ring 120.

As shown in FIG. 1A, the inner stator ring 118 may be disposed radially inward from the outer stator ring 120 and adjacent the rotary shaft 102 of the steam turbine 100. In an exemplary embodiment, a radially inward end portion of the inner stator ring may be coupled to a seal member 122, such as a labyrinth seal. The labyrinth seal 122 may include or define one or more teeth (not shown) extending radially and disposed adjacent the rotary shaft 102. As arranged, the labyrinth seal 122 may be in a sealing relationship with the rotary shaft 102 and thus may be configured to substantially prevent the flow of the process fluid therethrough.

The stator vanes 116 may be disposed circumferentially about and radially outward from a center axis 124 of the steam turbine 100. The stator vanes 116 may be equally spaced about the center axis 124, or in another embodiment, the stator vanes 116 may be arranged asymmetrically about the center axis 124. As arranged, the stator vanes 116 may extend between the inner stator ring 118 and the outer stator ring 120 and through the flow path 108 formed therebetween through which the process fluid passes. The stator vanes 116 may be further oriented to increase the velocity of the process fluid flowing therethrough and further direct the process fluid to the axially spaced rotor assembly 114.

The rotor assembly 114 may include a rotor disc 126, or turbine wheel, disposed in the cavity 106 and axially spaced from the diaphragm 112. The rotor disc 126 may be coupled to or integral with the rotary shaft 102 of the steam turbine 100 and thus configured to rotate therewith about the center axis 124. The rotor disc 126 may include a hub defining a bore (not shown) through which the rotary shaft 102 extends. The rotor assembly 114 may further include a plurality of rotor blades 128 attached to the rotor disc 126 and configured to rotate in response to contact from the process fluid exiting the stator vanes 116. The rotor blades 128 may each include a root (not shown) and an airfoil 130 separated by a platform 132. Each root may be configured to be inserted into and retained in a respective slot (not shown) defined by the rotor disc 126 via any retaining structure or method known to those of skill in the art. As disposed in the steam turbine 100, the airfoil 130 of each rotor blade 128 may extend into the flow path 108 and may be contacted by the process fluid exiting the stator vanes 116, thereby rotating the rotor blades 128 and the rotary shaft 102 coupled therewith.

Figure 1B:
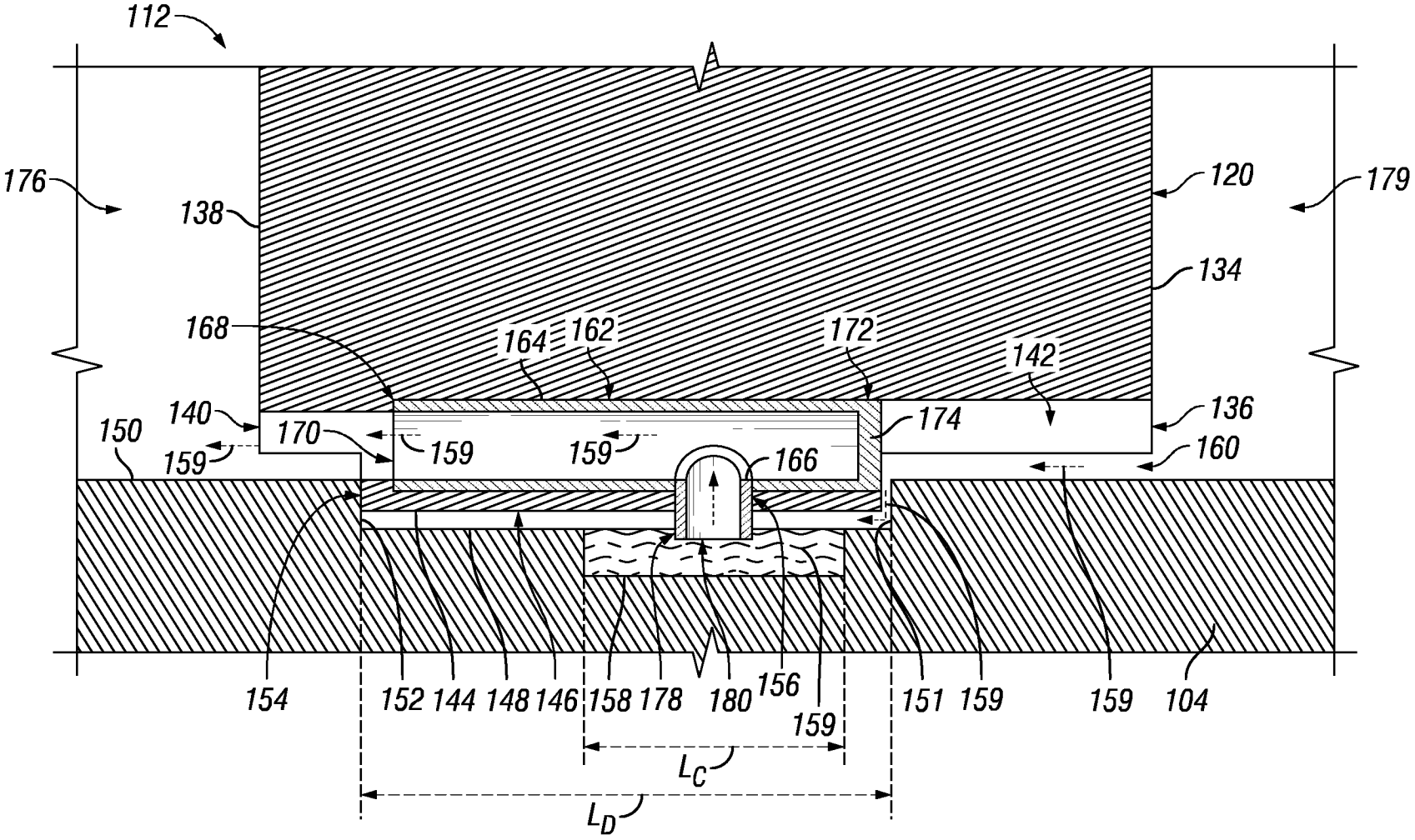
FIG. 1B illustrates an enlarged view of the portion of the steam turbine indicated by the box labeled "1B" in FIG. 1A, according to one or more embodiments.

Referring now to FIG. 1B with continued reference to FIG. 1A, FIG. 1B illustrates an enlarged view of the portion of the steam turbine 100 indicated by the box labeled "1B" in FIG. 1A, according to one or more embodiments. Although the description of FIG. 1B herein is in reference to the last stage 110*c*, it will be appreciated that the disclosure thereof is non-limiting and may be incorporated into one or both of the other stages 110*b*, 110*a*. The diaphragm 112 may include an upstream annular face 134 defining an upstream face opening 136 and a downstream annular face 138 axially opposing the upstream annular face 134 and defining a downstream face opening 140. The diaphragm 112 may further define a hole or slot 142 axially oriented and extending between the upstream face opening 136 and the downstream face opening 140. The axially oriented slot 142 may be formed by milling or any other process known in the art. As arranged, the axially oriented slot 142 may be located at or proximal the bottom dead center of the diaphragm 112.

The outer stator ring 120 of the diaphragm 112 may have an outer surface 144 extending axially between the upstream annular face 134 and the downstream annular face 138. As more clearly illustrated in FIG. 1B, a portion of the outer surface 144 may form an annular rib 146 extending radially outward from the remainder of the outer surface 144. The annular rib 146 may be disposed within an annular diaphragm recess 148 defined by an inner surface 150 of the casing 104 of the steam turbine 100, such that the annular diaphragm recess 148 may be bounded by an upstream radially extending surface 151 and a downstream radially extending surface 152 of the inner surface 150 of the casing 104. The annular diaphragm recess 148 and the annular rib 146 may be configured to form a seal between the annular rib 146 and the downstream radially extending surface 152 of the inner surface 150 of the casing 104, referred to herein as the seal face 154, as the pressure differential caused by the expansion of the process fluid flowing therethrough urges the annular rib 146 against the downstream radially extending surface 152 of the inner surface 150 of the casing 104.

The annular rib 146 of the diaphragm 112 may define a slot 156 radially oriented and extending radially inward from the outer surface 144 and terminating in the axially oriented slot 142. As disposed in the annular diaphragm recess 146, the radially oriented slot 156 may be radially aligned with an annular collection recess 158 defined by the inner surface 150 of the casing 104 and extending radially outward from a portion of the annular diaphragm recess 146. Accordingly, the annular collection recess 158 may be sized and configured to receive and collect condensate 159 or other moisture provided by the process fluid via a radial gap 160 disposed upstream thereof. The radial gap 160 may be in fluid communication with the annular collection recess 158 and may be defined by the outer surface 144 of the diaphragm 112 and the inner surface 150 of the casing 104, as shown most clearly in FIG. 1B. Such fluid communication may result from gravity, vorticity caused by the spinning rotor disc 126, and the pressure differential caused by the expansion of the process fluid across the diaphragm 112 urging the condensate 159 accumulated at the bottom of the casing 104 through the radial gap 160 and into the annular collection recess 158. Due to the accumulation of the condensate 159 in the annular collection recess 158, contact of the condensate 159 with the seal face 154 may be substantially reduced or prevented.

As shown most clearly in FIG. 1B, in an exemplary embodiment, a tubular member 162 may be disposed in the diaphragm 112 and configured to provide in part a fluid pathway for the removal of condensate 159 from the annular collection recess 158 and the last stage 110*c*. In another embodiment, the axially oriented slot 142 and the radially oriented slot 156 may form in part the fluid pathway for the removal of the condensate 159 from the annular collection recess 158 and the last stage 110*c*. The tubular member 162 may be constructed from a non-corrosive material, such as, for example, stainless steel, and may be utilized in part to substantially reduce or eliminate erosion within the axially extending slot 142 and the radially extending slot 156. The tubular member 162 may include an axially extending tubular portion 164 disposed in the axially oriented slot 142 and a radially extending tubular portion 166 disposed in the radially oriented slot 156. As arranged, the radially extending tubular portion 166 may be sized and configured to fluidly couple the annular collection recess 158 and the axially extending tubular portion 164.

The axially extending tubular portion 164 may include a downstream axial end portion 168 defining a downstream tubular member opening 170. The axially extending tubular portion 164 may also include an upstream axial end portion 172 axially opposing the downstream axial end portion 168 and including an end wall 174 configured to prevent condensate 159 flowing into the axially oriented slot 142 from entering the tubular member 162 via the upstream axial end portion 172. Accordingly, as arranged in the diaphragm 112, the axially extending tubular portion 164 may be in fluid communication with a downstream portion 176 of the cavity 104 of the steam turbine 110 via the downstream face opening 140 and the downstream tubular member opening 170.

The radially extending tubular portion 166 may include a radial end portion 178 defining an upstream tubular member opening 180, where in part a fluid pathway may extend between the upstream tubular member opening 180 and the downstream face opening 140. In an exemplary embodiment, the radial end portion 178 may extend into and may be disposed within the annular collection recess 158. Accordingly, as the condensate 159 in the annular collection recess 158 reaches the upstream tubular member opening 180, the condensate 159 is drawn from the annular collection recess 158 due to the pressure differential and passed through the fluid pathway formed in the tubular member 162 and discharged from the downstream face opening 140 and the last stage 110*c*, thereby removing the condensate 159 from the last stage 110*c* and substantially reducing or preventing the condensate 159 from contacting the seal face 154 and thus substantially reducing or preventing the erosion thereof.

In an exemplary embodiment, the radially extending tubular portion 166 may be axially adjacent the upstream axial end portion 172 relative to the downstream axial end portion 168. Accordingly, the annular collection recess 158 may radially extend from the annular diaphragm recess 146 in an axially offset manner from an axial midpoint of the annular diaphragm recess 146. As arranged, the annular collection recess 158 may be disposed axially adjacent the upstream radially extending surface 151 relative to the downstream radially extending surface 152 of the inner surface 150 of the casing 104. In an exemplary embodiment, the axial length ($L_C$) of the annular collection recess 158 may be less than the axial length ($L_D$) of the annular diaphragm recess 146. Via this arrangement, the annular collection recess 158 may be further axially spaced from the seal face 154, thus substantially reducing or preventing the contact of the condensate 159 with the seal face 154.

With continued reference to FIGS. 1A and 1B, an exemplary operation of one or more embodiments is provided. Process fluid including steam may be provided from an external source, such as a geothermal source, a boiler, or other steam generation plant, and fed to the turbine inlet (not shown) of the steam turbine 100. The process fluid may flow though the flow path 108 defined in part by the cavity 104 of the steam turbine 100 and may be directed to one or more stages 110*a-c* in the steam turbine 100. For ease of explanation, the operation of the drainage system of the steam turbine 100 will be described with reference to the final stage 110*c* thereof; however, it will be appreciated that the following operation may apply to a plurality of stages, including one or both stages 110*a*, 110*b* of the multi-stage steam turbine 100.

As the process fluid passes through the flow path 108, a temperature and pressure drop occurs in the expansion of the process fluid in each stage 110*a-c*. Accordingly, as the process fluid enters the stage 110*b*, the pressure and temperature of the process fluid is less than the pressure and temperature of the process fluid at the previous stage 110*a* and is greater than the pressure and temperature of the process fluid entering the following stage 110*c*. Thus, the portion 179 of the cavity upstream of the stage will be at a relatively higher pressure than the portion 176 of the cavity downstream from the stage.

With reference to the stage 110*b*, the process fluid may be directed to the diaphragm 112 and the stator vanes 116 thereof, where the velocity of the process fluid including the steam will be increased and the process fluid will be further directed to the axially spaced rotor assembly 114. Moisture in the process fluid contacts the rotating rotor blades 128 and is thrown therefrom centrifugally, where the moisture in the form of condensate 159 collects at the bottom of the casing 104 adjacent the diaphragm 112 of the last stage 110*c*. As the process fluid is expanded through the diaphragm 112, a pressure differential occurs between the portion 179 of the cavity 104 upstream of the diaphragm 112 and the portion 176 of the cavity 104 downstream of the diaphragm 112. The condensate 159 may be drawn through the radial gap 160 defined between the outer surface 144 of the outer stator ring 120 and the inner surface 150 of the casing 104 and may be collected in the annular collection recess 158 defined by the inner surface 150 of the casing 104. As the process fluid is expanded, the diaphragm 112 is forced in the direction of the downstream portion 176 of the cavity 104, thereby forming the seal at the seal face 154, i.e., the location of the contact between the diaphragm 112 and the downstream radially extending surface 152 of the inner surface 150 of the casing 104. Accordingly, the condensate 159 may be prevented or substantially reduced from contacting the seal face 154 due to the collection of the condensate 159 in the annular collection recess 158.

Before the condensate 159 exceeds the volume or capacity of the annular collection recess 158, the condensate 159 contacts a radially extending tubular portion 166 of a tubular member 162 disposed in the axially oriented slot 142 and the radially oriented slot 156 defined in the diaphragm 112. Due to the pressure differential across the diaphragm 112, the condensate 159 is drawn though an upstream tubular member opening 180 in the radially extending tubular portion 166 and fed to an axially extending tubular portion 164 of the tubular member 162, where the condensate 159 is flowed through the downstream tubular member opening 170 and though the downstream face opening 140 of the diaphragm 112. Accordingly, the condensate 159 is removed from the stage 110*c* without contact or with substantially reduced contact of the condensate 159 with the seal face 154. The condensate 159 may be directed to a drain 182 disposed downstream from the stage 110*c* and fluidly coupled to a condenser (not shown). In an exemplary embodiment, the condensate 159 may be discharged from the condenser and returned to the external source, e.g., a boiler.

Figure 2:
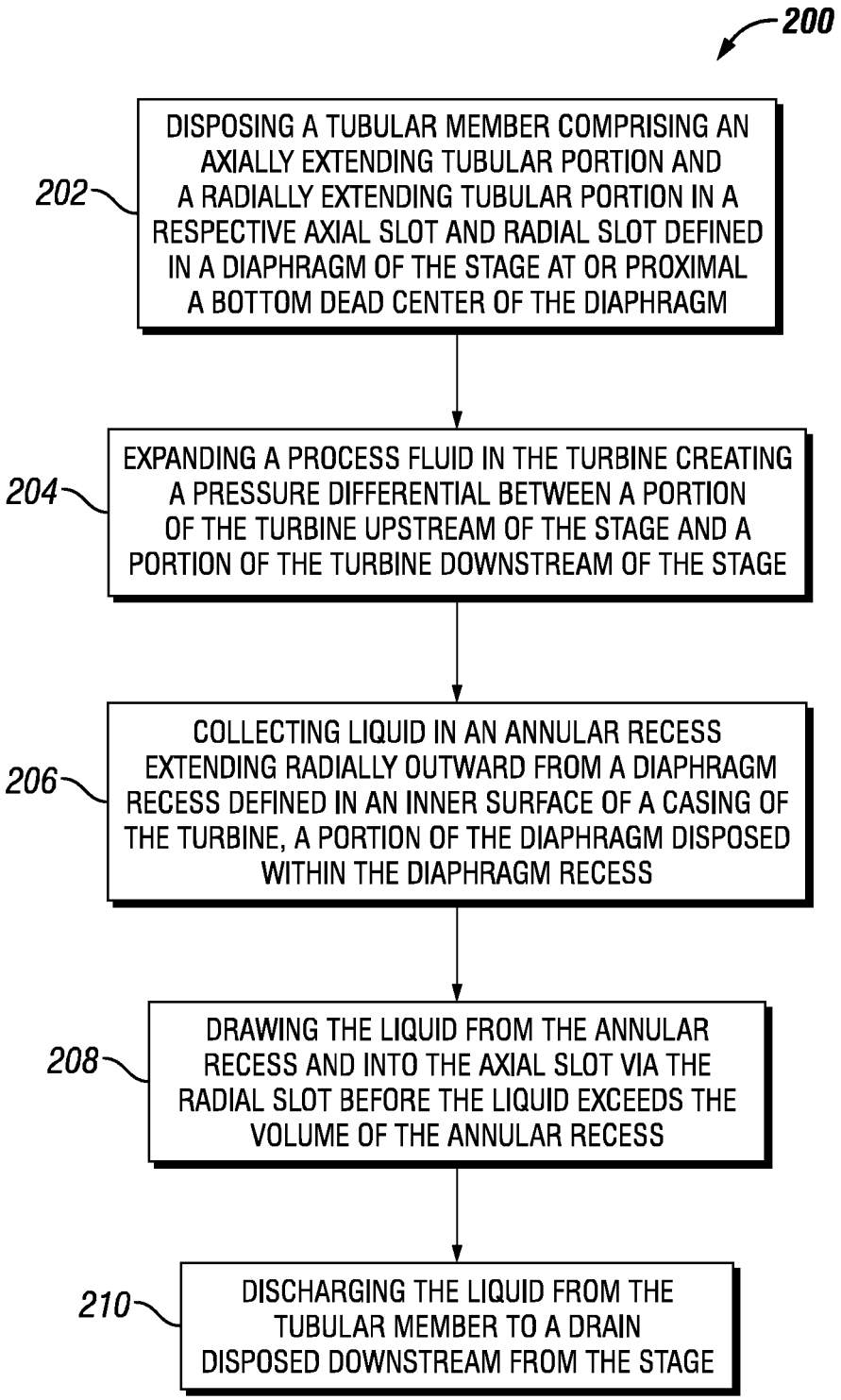
FIG. 2 is a flowchart depicting a method for removing liquid from a stage of a turbine, according to one or more embodiments.

FIG. 2 is a flowchart depicting a method 200 for removing liquid from a stage of a turbine, according to one or more embodiments. The method 200 may include disposing a tubular member including an axially extending tubular portion and a radially extending tubular portion in a respective axial slot and radial slot defined in a diaphragm of the stage at or proximal a bottom dead center of the diaphragm, as at 202. The axially extending tubular portion may include a first axial end portion defining a first tubular member opening, and a second axial end portion including an end wall configured to prevent liquid flowing into the axial slot from entering the tubular member via the second axial end portion. The radially extending tubular portion may include a radial end portion defining a second tubular member opening, wherein the radial end portion may be disposed within the annular recess. The method 200 may also include expanding a process fluid in the turbine creating a pressure differential between a portion of the turbine upstream of the stage and a portion of the turbine downstream of the stage, as at 204.

The method 200 may further include collecting liquid in an annular recess extending radially outward from a diaphragm recess defined in an inner surface of a casing of the turbine, a portion of the diaphragm disposed within the diaphragm recess, as at 206. The method 200 may also include drawing the liquid from the annular recess and into the axial slot via the radial slot before the liquid exceeds the volume of the annular recess, as at 208. The method 200 may further include discharging the liquid from the tubular member to a drain disposed downstream from the stage, as at 210. The drain may be configured to fluidly couple the annular recess and a condenser. In another embodiment, the method 200 may also include drawing the liquid via the pressure differential from the portion of the turbine upstream of the stage to the annular recess via a radial gap defined between the diaphragm and the inner surface of the casing.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A drainage system for a stage of a turbine, comprising:
a casing defining a cavity and comprising
a center axis; and
an inner surface defining at least one annular recess sized and configured to accumulate liquid therein;
a diaphragm disposed within the cavity and comprising
a first annular face defining a first face opening;
a second annular face axially opposing the first annular face and defining a second face opening, the diaphragm defining a first slot extending axially between the first face opening and the second face opening; and
an outer surface extending between the first annular face and the second annular face and forming an annular rib disposed in the at least one annular recess, the annular rib defining a second slot extending radially outward from the first slot; and
a tubular member comprising an axially extending tubular portion disposed in the first slot and a radially extending tubular portion disposed in the second slot, the radially extending tubular portion sized and configured to fluidly couple the at least one annular recess and the axially extending tubular portion.

2. The drainage system of claim 1, wherein:
the at least one annular recess defined by the inner surface includes a first annular recess and a second annular recess, the second annular recess extending radially outward from the first annular recess and sized and configured to accumulate liquid therein; and
the axially extending tubular portion comprises
a first axial end portion defining a first tubular member opening; and
a second axial end portion comprising an end wall configured to prevent liquid flowing into the first slot from entering the tubular member via the second axial end portion.

3. The drainage system of claim 2, wherein the radially extending tubular portion comprises a radial end portion defining a second tubular member opening, wherein a fluid pathway extends between the second tubular member opening and the first face opening.

4. The drainage system of claim 3, wherein the radial end portion is disposed within the second annular recess.

5. The drainage system of claim 4, wherein the radially extending tubular portion is axially adjacent the second axial end portion relative to the first axial end portion.

6. The drainage system of claim 5, further comprising a drain configured to fluidly couple the fluid pathway and a condenser.

7. The drainage system of claim 2, wherein an axial length of the second annular recess is less than an axial length of the first annular recess.

8. The drainage system of claim 1, wherein the first annular face is disposed downstream from the second annular face in the turbine.

9. The drainage system of claim 1, wherein a radial gap is defined between the outer radial surface and the inner surface of the casing, the radial gap fluidly coupling the at least one annular recess and a portion of the cavity upstream of the diaphragm.

10. An expander, comprising:
a casing defining a cavity and comprising
a center axis; and
an inner surface defining a first annular recess and a second annular recess, the second annular recess extending radially outward from the first annular recess and sized and configured to accumulate liquid therein;
a rotary shaft at least partially disposed within the cavity and configured to rotate about the center axis;
at least one stage comprising
a rotor assembly disposed within the cavity and comprising a rotor disc coupled to the rotary shaft and a plurality of rotor blades coupled to and extending radially from the rotor disc; and
a stator assembly comprising a plurality of stator vanes disposed circumferentially about the center axis and extending radially inward from an outer stator ring, the outer stator ring comprising
an upstream face; and
a downstream face, the outer stator ring defining a first slot extending axially between the upstream face and the downstream face; and
an outer surface forming an annular rib disposed in the first annular recess, the annular rib defining a second slot extending radially inward from the outer surface and terminating in the first slot; and
a drain defined in the inner surface of the casing and disposed downstream from the at least one stage and configured to fluidly couple the second annular recess with a condenser via a fluid pathway formed in part from the first slot and the second slot.

11. The expander of claim 10, further comprising a tubular member comprising an axially extending tubular portion disposed in the first slot and a radially extending tubular portion disposed in the second slot, the radially extending tubular portion sized and configured to fluidly couple the second annular recess and the axially extending tubular portion.

12. The expander of claim 11, wherein:

the upstream face defines an upstream face opening;

the downstream face defines a downstream face opening;

the first slot extends axially between the upstream face opening and the downstream face opening; and the axially extending tubular portion comprises:

a first axial end portion defining a first tubular member opening; and a second axial end portion comprising an end wall configured to prevent liquid flowing into the first slot from entering the tubular member via the second axial end portion.

13. The expander of claim 12, wherein the radially extending tubular portion comprises a radial end portion defining a second tubular member opening, wherein a portion of the fluid pathway extends between the second tubular member opening and the downstream face opening.

14. The expander of claim 13, wherein a radial gap is defined between the outer surface of the outer stator ring and the inner surface of the casing, the radial gap fluidly coupling the second annular recess and a portion of the cavity upstream of the stator assembly.

15. The expander of claim 10, wherein an axial length of the second annular recess is less than an axial length of the first annular recess.

16. The expander of claim 10, wherein the stator assembly further comprises:

an inner stator ring disposed radially inward from the outer stator ring and coupled to the plurality of stator vanes extending therebetween; and an annular seal coupled to the inner stator ring and configured to provide a sealing relationship between the inner stator ring and the rotary shaft.

17. A method for removing liquid from a stage of a turbine, comprising:

disposing a tubular member comprising an axially extending tubular portion and a radially extending tubular portion in a respective axial slot and radial slot defined in a diaphragm of the stage at or proximal a bottom dead center of the diaphragm;

expanding a process fluid in the turbine creating a pressure differential between a portion of the turbine upstream of the stage and a portion of the turbine downstream of the stage;

collecting liquid in an annular recess extending radially outward from a diaphragm recess defined in an inner surface of a casing of the turbine, a portion of the diaphragm disposed within the diaphragm recess;

drawing the liquid from the annular recess and into the axial slot via the radial slot before the liquid exceeds the volume of the annular recess; and discharging the liquid from the tubular member to a drain disposed downstream from the stage.

18. The method of claim 17, wherein:

the axially extending tubular portion comprises a first axial end portion defining a first tubular member opening; and a second axial end portion comprising an end wall configured to prevent liquid flowing into the axial slot from entering the tubular member via the second axial end portion; and the radially extending tubular portion comprises a radial end portion defining a second tubular member opening, wherein the radial end portion is disposed within the annular recess.

19. The method of claim 17, further comprising drawing the liquid via the pressure differential from the portion of the turbine upstream of the stage to the annular recess via a radial gap defined between the diaphragm and the inner surface of the casing.

20. The method of claim 17, wherein the drain is configured to fluidly couple the annular recess and a condenser.

* * * * *